United States Patent [19]

Yurtin

[11] 4,046,450

[45] Sept. 6, 1977

[54] ELECTRICAL TERMINAL WITH RETRACTED LATCH AND ELECTRICAL CONNECTOR HAVING SAME

[75] Inventor: John A. Yurtin, Southington, Ohio

[73] Assignee: General Motors Corporation, Detroit, Mich.

[21] Appl. No.: 738,462

[22] Filed: Nov. 3, 1976

[51] Int. Cl.[2] ..... H01R 9/08
[52] U.S. Cl. ..... 339/217 S
[58] Field of Search ..... 339/217 S, 217 J

[56] References Cited

U.S. PATENT DOCUMENTS 3,562,698 2/1971 Merry ..... 339/217 S

*Primary Examiner*—Gerald A. Dost
*Attorney, Agent, or Firm*—F. J. Fodale

[57] ABSTRACT

An electrical connector comprises a connector body having a longitudinal cavity which receives an electrical terminal to be retained therein. The terminal is retained in the connector body by a latch portion of the terminal which is protracted by a central rib in the cavity into engagement with a latch shoulder in the cavity. The latch is normally in a retracted position to provide protection against damage and entanglement during handling.

4 Claims, 6 Drawing Figures

ELECTRICAL TERMINAL WITH RETRACTED LATCH AND ELECTRICAL CONNECTOR HAVING SAME

This invention relates generally to electrical connectors and more specifically to electrical connectors having terminals provided with a latch for securing the terminal in a cavity of the connector body.

One of the common ways terminals are secured in a connector body cavity is by means of a resilient, angularly bent, protruding latch of the terminal engaging a cooperating latch shoulder in the cavity of the connector body. Such terminals are commonly of unitary sheet metal construction and often are produced in a continuous strip comprising a plurality of terminals connected, usually side-by-side, either directly to each other or by intermediate discardable carrier strip portions. The strips of terminals are then commonly wound on a reel which feeds an assembly machine which on each stroke cuts off the end terminal and crimps the open barrel portion of the terminal to an insulated electrical lead.

The winding and unwinding of the terminal strip and the handling of the reels affords ample opportunity for the angularly bent protruding latch to be bent out of shape resulting in damage which ordinarily cannot be detected until after the terminal is attached to the wire. The protruding latches also present the possibility of the wound strips becoming tangled resulting in machine downtime or the terminated lead wires becoming tangled resulting in increased assembly time for inserting the terminated ends of the lead wires into the connector body cavities. In short, the protruding latches are a drawback from the standpoint of damageability and entanglement.

The object of this invention is to provide an electrical terminal having an improved anti-tangling latch.

Another equally important object of this invention is to provide an electrical terminal having a latch which is protected against damage during handling and attachment to an insulated electrical lead.

Still another object of this invention is to provide an electrical terminal having a latch which is normally in a retracted position for protection against damage and tangling during handling of the terminal prior to assembly in a connector body cavity.

Yet another object of this invention is to provide an electrical connector means comprising an electrical terminal having a normally retracted latch for protection during handling and a connector body having a cooperatively designed terminal cavity for projecting the latch to secure the electrical terminal therein.

Figure 1:
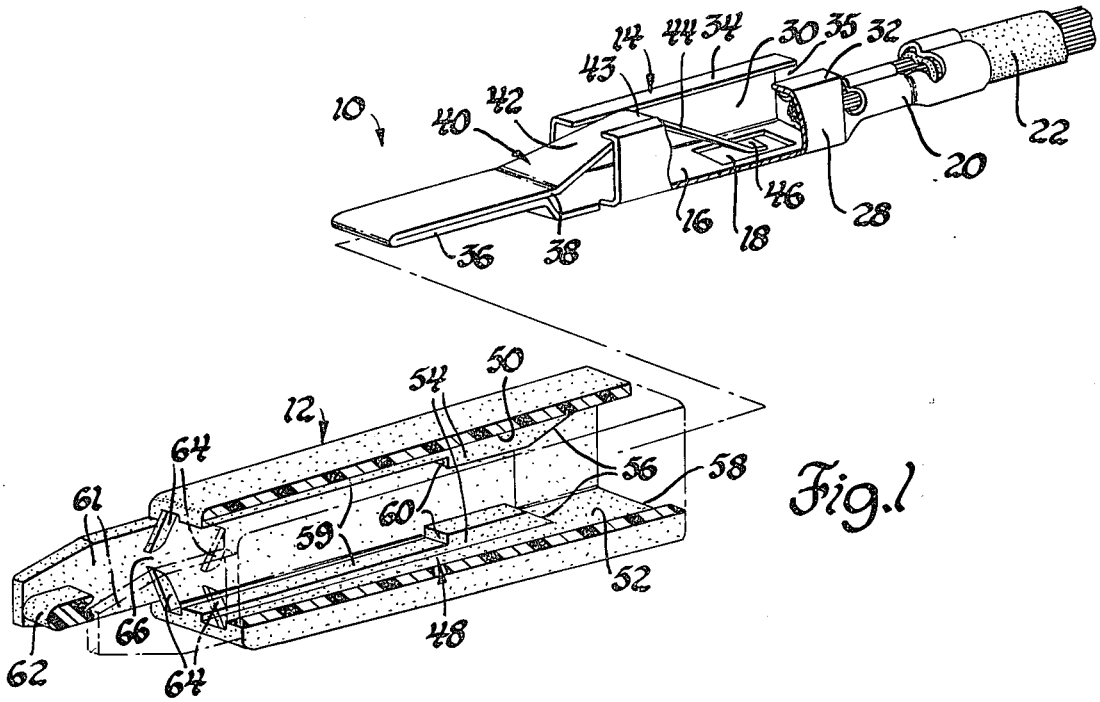
Figure 2:
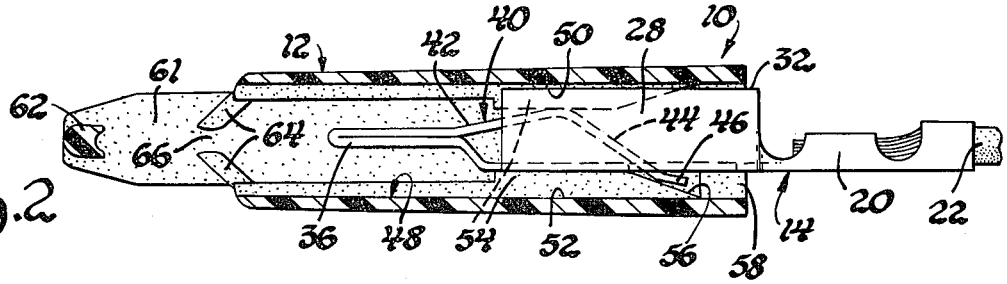
Figure 3:
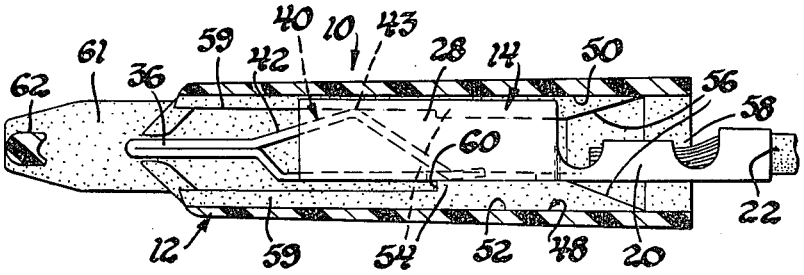
Figure 4:
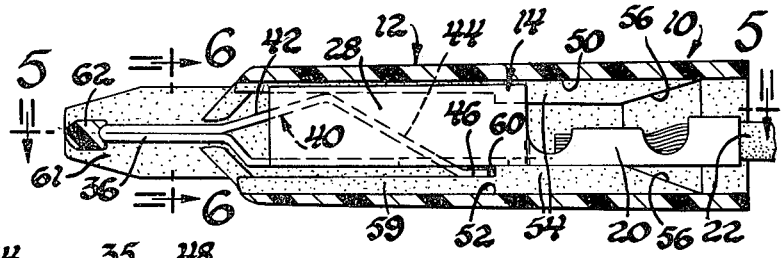
Figure 5:
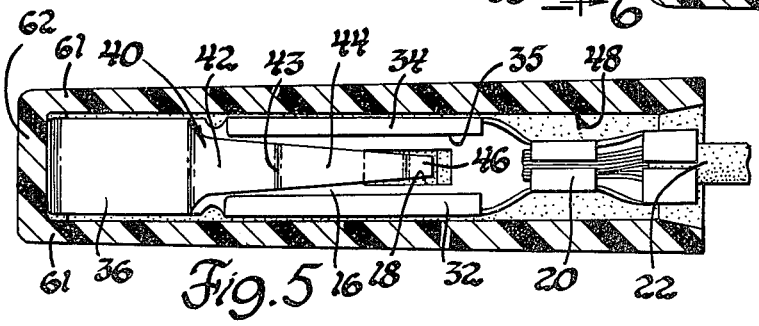
Figure 6:
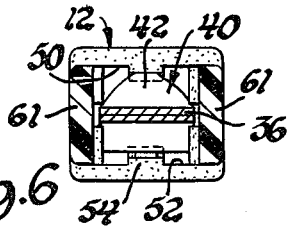

Other objects and features of the invention will become apparent to those skilled in the art as the disclosure is made in the following detailed description of a preferred embodiment of the invention as illustrated in the accompanying sheet of drawing in which:

FIG. 1 is an exploded partially sectioned perspective view of an electrical connector comprising a connector body and terminal embodying the invention, FIG. 2 is a longitudinal partially sectioned view of the connector body and terminal shown in FIG. 1 during an initial stage of assembly, FIG. 3 is a longitudinal partially sectioned view similar to FIG. 2 showing a subsequent stage of assembly, FIG. 4 is a longitudinal partially sectioned view showing the terminal and connector body completely assembled, FIG. 5 is a section taken substantially along the line 5—5 of FIG. 4 and looking in the direction of the arrows, FIG. 6 is a section taken substantially along the line 6—6 of FIG. 4 and looking in the direction of the arrows.

Referring now to the drawings there is disclosed an electrical connector 10 comprising an electrically insulative connector body 12 of molded plastic construction and an electrically conductive terminal 14 of unitary sheet metal construction.

The terminal 14 comprises a forward floor portion 16 which has a rectangular aperture 18 extending therethrough and a smooth projectionless bottom surface. A rearward barrel portion 20 of conventional design connects the terminal 14 to an insulated electrical lead 22 by pairs of wings respectively crimped about the end of the conductor core and the insulator jacket. The floor portion 16 has generally perpendicular side walls 28 and 30 connected to its respective longitudinal side edges. The upper or free ends of the side walls 28 and 30 have inturned flanges 32 and 34 respectively which are relatively short in the lateral direction in order to provide a wide longitudinal slot 35 so as to not interfere with the operation of the latch as will hereinafter more fully appear. The electrical terminal 14 is a male type terminal and consequently includes a blade portion 36 which projects forwardly of the floor portion 16. The blade portion 36 is displaced upwardly or raised from the floor portion 16 and reversed upon itself so that it is of double thickness. The rear end 38 of the upper layer of the blade portion 36 serves as a support for a latch arm 40 which extends rearwardly in cantilever fashion. The latch arm 40 comprises a forward portion 42 which diverges away from the floor 16 in the rearward direction; a rearward portion 44 which converges toward the floor portion 16 in the rearward direction; and a latch tab 46 at its free end which is coplanar with the floor portion 16 and disposed in the aperture 18. The latch arm portions aligned with the slot 35 are preferably narrower than the slot 35. The peak 43 of the latch arm may be disposed in the slot 35 when the latch arm is in the free unstressed state as shown in FIG. 1 and in any event preferably is no higher than the flanges 32 and 34 defining the slot 35.

The connector body 12 has a longitudinal terminal receiving cavity 48 which is symmetrical to a horizontal bisecting plane so that the terminal 14 may be received either in the right side up orientation shown in FIG. 1 or upside down. Thus the top and bottom walls 50 and 52 of the connector body 12 each have an identical central rib 54 projecting into the cavity 48. Each central rib 54 has a rearward ramp portion 56 spaced forwardly of the rear opening 58 and a forward portion 59 which is reduced in height to provide a forwardly facing shoulder 60. The width of each rib 54 is less than the width of the longitudinal slot 35 defined by the flanges 32 and 34 so as to fit therebetween and operate upon the latch arm 40 of the terminal 14.

The side walls 61 of the connector body 12 which extend forwardly of the top and bottom walls 50 and 52 are connected at their forward end by a cross piece 62 which serves as a forward stop for the terminal 14. The projecting portions of the side walls 61 each have a pair of bosses 64 which form a slot 66 receiving an edge of the blade portion 36 of the terminal 14 to stabilize the same.

For assembly the terminal 14 is inserted into the cavity 48 through the rear opening 58 as shown in FIG. 2. As the terminal is inserted further into the cavity 48, the ramp portion 56 of the bottom wall 52 cams the floor portion 16 upwardly onto the bottom central rib 54 while the ramp portion 56 of the top wall 50 enters the longitudinal slot 35 and engages the forward portion 42 of the latch arm 40 depressing the latch arm 40 and projecting the latch tab 46 below the floor portion 16. Due to the resilience of the latch arm 40, the latch tab 46 is biased against the floor of the cavity 48. The biased latch tab 46 then rides up the bottom ramp portion 56 of the bottom rib 54 while the peak 43 of the latch arm 40 rides over the higher mid portion of the top central rib 54 to the position shown in FIG. 3 where the peak 43 engages the lower portion of the top central rib 54 ahead of the top latch shoulder 60. As the terminal is further inserted to the fully assembled position shown in FIG. 4, the latch tab 46 snaps down into position against the shoulder 60 securing the terminal 14 in the cavity 48.

While a single male terminal and single cavity connector body have been disclosed, the invention may also be embodied in a female terminal or an electrical connector having a plurality of either type terminals and a plural cavity connector body. In other words the invention is not limited to the exact details of construction shown and described, for obvious modifications will occur to a person skilled in the art.

What is claimed is:

1. An electrical terminal for:

a connector body having a longitudinal cavity having a rearward opening for receiving the electrical terminal and retaining the same in the cavity which is defined in part by a pair of laterally spaced longitudinal walls, one wall of which has means providing a forward facing latch shoulder for cooperative engagement with a projecting latch portion of the terminal, said electrical terminal comprising a floor portion having an aperture extending therethrough, and a smooth projectionless bottom surface, and a resilient latch arm extending rearwardly in cantilever fashion from support means at the forward end of said floor portion, said latch arm having a forward portion diverging away from said floor portion in the rearward direction, a rearward portion extending toward said floor and a latch portion at its free end which is aligned with said aperture, said latch arm in its free unstressed state having said latch portion located in a retracted position whereat said latch portion is no lower than portions of the floor portion adjacent the aperture therethrough, and said forward portion of the latch arm having an exposed upper surface for moving said latch arm to a position whereat said latch portion projects below the floor portion.

2. An electrical terminal for:

a connector body having a longitudinal cavity having a rearward opening for receiving the electrical terminal and retaining the same in the cavity which is defined in part by a pair of laterally spaced longitudinal walls, one wall of which has means providing a forward facing latch shoulder for cooperative engagement with a projecting latch tab of the terminal, said electrical terminal comprising a floor portion having an aperture extending therethrough and a smooth projectionless bottom surface, perpendicular side walls connected to the longitudinal edges of the floor portion, means defining a wide longitudinal slot at the upper ends of the side walls, and a resilient latch arm extending rearwardly in cantilever fashion between said side walls from support means spaced above the forward end of the floor portion, said latch arm having a forward portion diverging away from said floor portion in the rearward direction, a rearward portion converging toward said floor in the rearward direction and a latch tab at its free end which is aligned with said aperture, said latch arm in its free unstressed state having said latch arm located in a retracted position whereat all portions of the latch arm are no higher than the means defining the wide longitudinal slot and said latch tab is no lower than portions of the floor portion adjacent the aperture therethrough, said latch arm being accessible via said wide longitudinal slot and movable to a position whereat said latch tab projects below said floor portion.

3. An electrical connector comprising:

a connector body having a longitudinal cavity having a rearward opening for receiving an electrical terminal to be retained therein, said cavity being defined in part by a pair of laterally spaced longitudinal walls, one wall of which has means providing a forward facing latch shoulder and an electrical terminal including a floor portion having an aperture extending therethrough and a resilient latch arm extending rearwardly in cantilever fashion from support means at the forward end of said floor portion, said latch arm having a forward portion diverging away from said floor portion in the rearward direction, a rearward portion extending toward said floor portion and a latch portion at its free end which is aligned with said aperture, said latch arm in its free unstressed state having said latch portion located in a retracted position whereat said latch portion is no lower than portions of the floor portion adjacent the aperture therethrough, and said electrical terminal being disposed in said cavity and being retained therein by said latch portion engaging said latch shoulder of said one wall, said latch tab being located in a projecting position below said floor portion by engagement of said latch arm with portions of said other wall spaced forwardly of said latch shoulder.

4. An electrical connector comprising:

a connector body having a longitudinal cavity having a rearward opening for receiving an electrical terminal to be retained therein, said cavity being defined in part by a pair of identical laterally spaced longitudinal walls, each of which has a central rib having a rearward ramp portion and a forward portion of reduced height providing a forward facing latch shoulder and an electrical terminal including a floor portion having an aperture extending therethrough, perpendicular side walls connected to longitudinal edges of the floor portions and a resilient latch arm extending rearwardly in cantilever fashion from support means spaced above the forward end of said floor portion, id latch arm having a forward portion diverging away from said floor portion in the rearward direction, a rearward portion converging toward said floor in the rearward direction and a latch tab at its free end which is aligned with said aperture, said latch arm in its free unstressed state having a peak between said forward and rearward portions located no higher than inturned flanges at the upper ends of said side walls and said latch tab located in a retracted position whereat said latch tab is no lower than portions of the floor portion adjacent the aperture therethrough, and said electrical terminal being disposed in said cavity and being retained therein by said latch tab engaging the latch shoulder of the rib of one of said walls and being located in a projected position below said floor portion by engagement of said latch arm with the forward portion of the rib of the other of said walls.

* * * * *

UNITED STATES PATENT AND TRADEMARK OFFICE

CERTIFICATE OF CORRECTION

PATENT NO. : 4,046,450

DATED : September 6, 1977

INVENTOR(S) : John A. Yurtin

It is certified that error appears in the above-identified patent and that said Letters Patent are hereby corrected as shown below:

Claim 4, column 5, line 3, "id" should read -- said --.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*